US006755200B1

(12) United States Patent
Hempfling et al.

(10) Patent No.: US 6,755,200 B1
(45) Date of Patent: Jun. 29, 2004

(54) METHOD FOR REDUCTION OF TOBACCO SPECIFIC NITROSAMINES

(75) Inventors: Walter P. Hempfling, Mechanicsville, VA (US); Gordon H. Bokelman, Chesterfield, VA (US); Maria Shulleeta, Richmond, VA (US)

(73) Assignee: Philip Morris Incorporated, New York, NY (US)

( * ) Notice: Subject to any disclaimer, the term of this patent is extended or adjusted under 35 U.S.C. 154(b) by 32 days.

(21) Appl. No.: 09/714,105

(22) Filed: Nov. 17, 2000

Related U.S. Application Data

(60) Provisional application No. 60/166,413, filed on Nov. 19, 1999.

(51) Int. Cl.[7] ..... A24B 15/00

(52) U.S. Cl. ..... 131/309; 131/300; 131/290; 131/313

(58) Field of Search ..... 131/290, 300, 131/309, 313; 432/500

(56) References Cited

U.S. PATENT DOCUMENTS

| | | | | |
|---|---|---|---|---|
| 42,319 A | | 4/1864 | Storer | |
| 1,927,984 A | * | 9/1933 | Krensky et al. | 131/58 |
| 3,845,774 A | | 11/1974 | Tso et al. | |
| 4,448,208 A | | 5/1984 | Friedrich et al. | |
| 4,716,911 A | * | 1/1988 | Poulose et al. | 131/297 |
| 5,040,550 A | | 8/1991 | Argyropoulos | |
| 5,125,420 A | * | 6/1992 | Livingston | 131/302 |
| 5,873,372 A | | 2/1999 | Honeycutt et al. | |

OTHER PUBLICATIONS

Effect of Air–Curing on the Chemical Composition of Tobacco, Anna Wiernik et al., Recent Adv. Tob. Sci, (1995), 21, pp. 39–80.

Notification of Transmittal of International Preliminary Examination Report dated Apr. 5, 2002 for PCT/US00/42228, priority date date Nov. 19, 1999, International Filing Date Nov. 17, 2000.

Written Opinion dated Oct. 12, 2001 for PCT/US00/42228, priority date Nov. 19, 1999, International Filing Date Nov. 17, 2000.

* cited by examiner

*Primary Examiner*—Dionne A. Walls
(74) *Attorney, Agent, or Firm*—Burns, Doane, Swecker & Mathis, LLP

(57) ABSTRACT

Tobacco is treated before or during curing to lower or eliminate bacterial populations and/or activity, fungal growth, and/or tobacco-specific nitrosamine or bacterial endotoxin levels in the cured tobacco, wherein the tobacco is treated with an effective amount of a wash solution. Air-cured tobacco may be cured in four weeks or less when treated with a wash solution of bicarbonate salts.

21 Claims, 1 Drawing Sheet

METHOD FOR REDUCTION OF TOBACCO SPECIFIC NITROSAMINES

This application claims priority under 35 §§ and/or 365 to Provisional Application No. 60/166,413 filed in U.S. on Nov. 19, 1999; the entire content of which is hereby incorporated by reference.

The invention relates generally to tobacco curing and more particularly to a method of treating and curing tobacco leaves so as to have low levels of or no detectable tobacco-specific nitrosarnines and a reduced level of bacterial endotoxins as compared to untreated, cured tobacco leaves.

BACKGROUND OF THE INVENTION

U.S. Pat. No. 5,040,550 to Argyropoulos and U.S. Pat. No. 4,448,208 to Friedrich et al. disclose processes of washing cured tobacco leaves or leaf pieces with both hot and cold water for extraction of resins, tar and nicotine as well as removal of pesticide residue.

It has been reported that air-cured and flue-cured tobacco contain tobacco-specific nitrosamines (TSNAs). See, "Effect of Air-Curing on the Chemical Composition of Tobacco", Anna Wiernik et al., Recent Adv. Tob. Sci, (1995), 21, pp. 39–80. According to Wiernik et al., TSNAs are not present in significant quantities in growing tobacco plants or fresh cut tobacco (green tobacco), but are formed during the curing process. Bacterial populations which reside on the tobacco leaves are stated to largely cause the formation of nitrites from nitrate during curing and possibly effect the direct catalysis of the nitrosation of secondary amines at physiological pH values. The affected secondary amines include tobacco alkaloids, which form TSNAs when nitrosated.

Star Tobacco and Pharmaceutical Co., Inc., has reported that it treats tobacco leaves before or during flue-curing by microwaving for purposes of reducing tobacco-specific nitrosamines. See WO 98/58555. The microwaving adds significant cost to the tobacco farmer, including the costs of excess handling and breakage of tobacco leaves, the microwave process, the microwave facility and the extra labor and time necessitated by the microwaving process. A further drawback to this method of reducing TSNAs is that microwaving of the tobacco leaves has a thermal effect upon the tobacco tissue resulting in heating of the tobacco leaves which may affect the taste and aroma of the smoke from the tobacco.

Because curing of tobacco leaves is normally performed by the farmer who grows the tobacco, a simple, economical and non-labor-intensive method of reducing the bacterial population and/or activity, TSNA levels and bacterial endotoxin levels of the cured tobacco leaves is desirable.

SUMMARY OF THE INVENTION

The present invention provides a method of treating tobacco prior to or during curing with an aqueous solution of bicarbonate or carbonate anions which is found to accelerate coloring of the tobacco during cure and thereby shorten curing time, particularly with Burley and other air cured tobaccos. When such treatment is coupled with the step of an immediate drying of the tobacco at conclusion of the curing process, the process achieves pronounced reductions in tobacco-specific nitrosamines and bacterial endotoxins in the cured tobacco leaves as compared to untreated cured leaves.

Accordingly, the present invention provides a method of treating air-cured tobacco with a wash solution of bicarbonate salt or carbonate salt, wherein the air-cured tobacco is cured in four weeks or less from the time of treatment with the wash solution, and has one or more of a reduced or eliminated amount of tobacco-specific nitrosamines, bacteria, bacterial activity and bacterial endotoxins. At the election of the practitioner, such air-cured tobacco may be selectively stripped from the stalk as the leaves turn brown during curing, and dried.

In another embodiment, leaf of Burley tobaccos or other variety of air-cured tobacco is primed at harvest, and the individual leaves are treated as described above, cured and dried so as to form cured leaves having a reduced or eliminated amount of tobacco-specific nitrosamines and bacterial endotoxins.

In another preferred embodiment, a tobacco leaf is treated with a wash solution of an antibacterial agent before or during curing, wherein upon completion of the curing process the treated tobacco leaf has a reduced or eliminated amount of tobacco-specific nitrosamines and bacterial endotoxins.

DETAILED DESCRIPTION OF THE INVENTION

Figure 1:
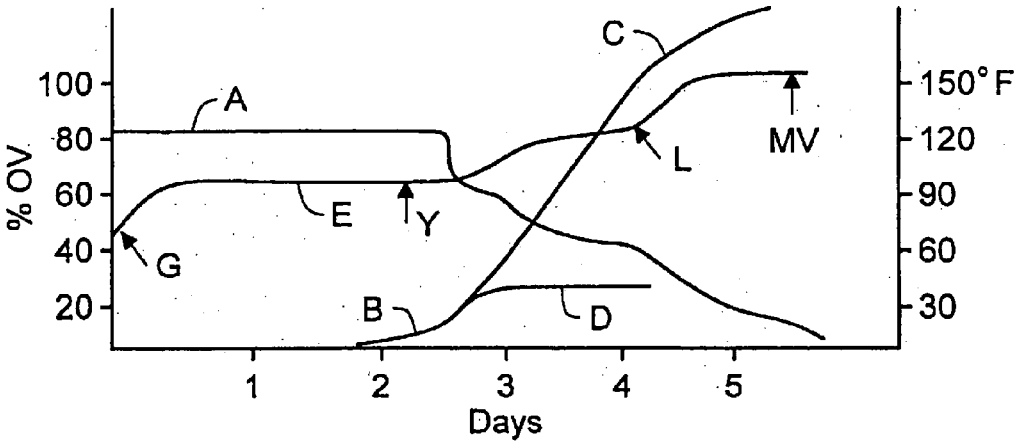
FIG. 1 is a general representation of typical moisture, temperature and TSNA content in tobacco during a traditional flue-curing process of the prior art heating with a direct flame and heating with use of a heat exchanger.

It is believed that TSNAs are generated by chemical breakdown of the tobacco leaf during the curing process or by the action of bacteria during the curing process. The present invention provides a process for reducing tobacco-specific nitrosamines, or TSNAs, generated during the curing of tobacco leaves.

Tobacco leaf or leaves, as used herein, is meant to include flue-cured and air-cured tobacco leaves which are green or partially cured. Thus, tobacco leaf or leaves may indicate the individual primed leaves of flue-cured tobacco (bright or Virginia tobacco), or the stalk-cut leaves as attached to the stalk of the tobacco plant or as individual leaves which have been primed. Cured tobacco indicates tobacco leaves which have completed the curing process.

Curing comprises the drying process for newly harvested tobacco. Air curing is performed in widely ventilated barns under natural atmospheric conditions (from which the name comes) with little or no artificial heat; it takes 3–12 weeks, usually 6 to 8 weeks. Light air-cured tobacco is very thin to medium in body, light tan shaded toward red to reddish brown in color, and mild in flavor. Burley is light air-cured. Dark air-cured is medium to heavy in body, light to medium brown in color. Flue curing is performed in small, tightly constructed barns with artificial heat beginning at 90° F. and ending around 170° F.; it takes 5–7 days. The name comes from the metal flues used in the heating apparatus. Flue-cured tobacco is yellow to reddish-orange in color, thin to medium in body, and mild in flavor. Fire curing is performed in ventilated barns with open fires (from which the name comes) allowing the smoke to come in contact with the tobacco; it is alternated with air curing. Fire-cured tobacco is light to dark brown in color, medium to heavy in body, and strong in flavor. Sun curing is performed on racks in the sunshine (from which the name comes) for set daily periods over 4 weeks, depending on the weather. Sun-cured tobacco looks similar to air-cured.

Harvesting tobacco is meant to include both priming and stalk-cutting of tobacco.

Priming is meant to include removal of a tobacco leaf from a growing or harvested tobacco plant.

Bacterial endotoxin, as used herein, is meant to include both bacterial endotoxins generated by bacterial activity, and materials which create a false positive for bacterial endotoxins in the Limulus Amoebocyte Lysate (LAL) assay, such as β-glucans generated by fungal activity.

Bacterial populations on tobacco leaves are known to grow linearly or exponentially (after a "lag") during curing in accordance with prior, traditional curing practice. Bacteria gain entrance into the tobacco leaf in large numbers through stomata or cracks formed in the leaf cuticle by tissue necrosis, particularly during lamina and stem drying of the tobacco. The bacterial population of tobacco leaves, when harvested is about $10^5$ to $10^6$ bacteria/gram of dry weight of tobacco leaf. The heat of the yellowing process during flue-curing and the prolonged exposure time of air-curing both result in growth of the bacterial population during yellowing. Bacterial populations may increase by 10 to 20 fold during this period. Many of these bacteria are capable of reducing nitrates to nitrites. The nitrites may accumulate in both the bacteria and the tobacco leaf cells. At least some of the same bacteria are also capable of catalyzing the nitrosation from nitrite of secondary amines.

Bacteria on tobacco leaves may result in the presence of bacterial endotoxins. The bacterial populations found on tobacco leaves are primarily gram negative bacteria, including pseudomonads and enterobacters. These bacteria form lipopolysaccharides, or bacterial endotoxins, which can remain as a residue even after the bacteria have been destroyed.

Fungi may be present on tobacco plants when harvested. Various fungi produce β-glucans, which can result in a false positive test for bacterial endotoxins, as quantified by the Limulus Amoebocyte Lysate (LAL) assay.

The inventors herein have devised novel and cost effective methods of reducing both the numbers and activity of bacterial and fungal populations and, therefore, TSNAs and bacterial endotoxins formed during the curing process. A preferred embodiment of the invention comprises treating tobacco leaves prior to or during flue curing or air curing by lavage with a wash solution having a temperature from about 1° C. to about 55° C.

"Antibacterial Lavage"

In accordance with a preferred embodiment of the invention, an antibacterial wash solution can be applied to green (e.g., growing or harvested tobacco plants or leaves) or partially cured tobacco and preferably is capable of killing or disrupting the biological activity of the bacteria and/or fungi present on tobacco leaves. It is desirable that the solution have minimal chemical reactivity with the tobacco leaf itself. It is an added advantage if the solution also is able to saponify fats, has a detergent effect, and/or is capable of raising the internal pH level of the tobacco leaves. Raising the pH of the tobacco leaf aids in reducing or eliminating nitrite levels by removing protons otherwise available for use in nitrosation reactions. It is most preferable that the solution have a bactericidal and/or bacteriostatic activity, and desirable that it be capable of acting as a surfactant.

The wash solution may include solutions of suitable disinfectants such as, but not limited to solutions of chlorine-containing compounds, such as chlorine dioxide, sodium hypochlorite and sodium chlorite; peroxides; low molecular weight alcohols, such as methanol, ethanol and propanol; quaternary ammonium compounds such as benzalkonium chloride, octyl decyl dimethyl ammonium chloride, decyl dirnethyl ammonium chloride, dioctyl dimethyl ammonium chloride and alkyl dimethyl benzyl ammonium chloride; and derivatives thereof. Other disinfectant solutions suitable for use will be apparent to practitioners in the art. The disinfectant solution may be used in any effective amount.

The disinfectant may be dissolved or dispersed in any suitable aqueous or non-aqueous solvent, including but not limited to water and polar organic solvents such as low molecular weight alcohols, including methanol, ethanol and propanol. Other suitable solvents will be apparent to practitioners in the art.

Particularly preferred solutions include disinfectant solutions of chlorine-containing compounds, preferably chlorine dioxide, dissolved in water. When the disinfectant is a low molecular weight alcohol, a preferred solution is 70% ethanol in water.

The disinfectant solution used to treat air-cured or flue-cured tobacco is most preferably a saturated solution, though any effective amount of disinfectant can be used. The solution may be used at any desired temperature, for example, ambient temperature. Depending on the particular disinfectant chosen, the temperature of the solution may be raised or lowered to increase solubility of the disinfectant. However, for ease of preparation and use, it is most desirable to use a disinfectant having good solubility at ambient temperature.

It may be desirable to add a surfactant to the wash solution in order for the wash solution to better adhere to the tobacco leaf surface. In particular, the addition of a surfactant is desirable when the disinfectant is a chlorine-containing compound. Surfactants used with chlorine-containing disinfectant compounds are preferably bleach stable surfactants. Suitable surfactants will be apparent to practitioners in the art, and may include, for example, Dowfax® and Dowfax 2A®, but are not limited thereto.

Tobacco leaves may be treated with a heated wash solution. For instance, the solution can be heated to a suitable temperature ranging from ambient up to about 55° C. The solution may be water or a disinfectant solution as described herein. While not wishing to be bound by theory, it is believed that the heated solution of water or disinfectant interrupts the biological activity of the bacteria and/or fungi. Preferably, the solution is hot enough to kill or arrest the activity of the bacteria or fungi on contact or over the time during which the bacteria and/or fungi are exposed to the solution by lavage while causing minimal or, preferably, no damage to the tobacco leaf.

Gram-negative bacteria, as well as other bacteria on tobacco leaves, are temperature sensitive. They thrive in increased heat, multiplying in numbers, but die when exposed to temperatures of about 50° C. or greater for an extended period of time. Therefore, the wash solution may be heated to a temperature of from about 25° C. to about 55° C. in order to kill or disrupt the biological activity of the bacteria. The length of lavage needed at any particular temperature to effectively reduce bacterial and fungal populations or their activity will be apparent to practitioners in the art based on factors such as the type and amount of bacteria and/or fungal growth present, the integrity of the tobacco leaves, and the like.

The solution, whether disinfectant, heated disinfectant or heated water, is applied to the tobacco leaves by any means possible, particularly by rinsing or spraying or dipping the leaves in the solution. Whether the tobacco leaves are sprayed or dipped, agitation of the tobacco leaves is helpful to evenly distribute the solution, and to aid in removing the bacterial and fungal populations by effectively shaking the bacteria and fungal growth off the tobacco leaves. Agitation of the leaves in multiple directions is preferable, for example, front to back, side to side and up and down. If the leaves are ravaged (washed) by spraying, it is preferred that the leaves be entirely soaked so that the solution is running freely from all leaf surfaces. Preferably, the tobacco leaves are dipped in the solution and agitated for a period of time. More preferably, the leaves are completely submerged for a period of at least 10 minutes, most preferably at least 15 to 20 minutes, with gentle agitation of the tobacco leaves throughout the entire period of submersion.

During lavage, some or all of the bacteria and fungi on the leaf surfaces are washed off the leaf surface. The bacteria may also be killed or harmed in the wash solution by other chemical or mechanical interactions effected by the lavage.

The tobacco leaves are preferably lavaged one or more times before completion of lamina drying or onset of necrosis in the leaves. In particular, lavage may be performed on green leaves, during yellowing, at the conclusion of yellowing, and, potentially, early during lamina drying. Lavage may be performed after yellowing and during lamina drying so long as the leaf cuticle is still substantially intact. It is desirable that the tobacco leaves not be washed after the cuticle of the tobacco leaves has been damaged to a significant extent, because this might allow the solution to penetrate into the interior of the tobacco leaf. Therefore, lavage of tobacco leaves may occur at any point, preferably before the leaf cuticle is substantially compromised.

It is preferable to lavage the tobacco leaves before or during yellowing to remove bacterial populations before they can significantly increase in number and before they can do a significant amount of damage to the tobacco leaves. In particular, it is most preferable to lavage green tobacco leaves, i.e., leaves which have not yet begun the curing process. Leaves undergoing yellowing may also be lavaged with good results. However, lavaging flue-cured tobacco leaves at the end of yellowing or during or after lamina drying of the flue-cured tobacco leaves is of lesser use because the heat of lamina drying and removal of water in flue-curing will eventually kill or arrest the activity of most bacteria dependent upon the degree to which desiccation of the leaf is achieved.

Lavage of the tobacco leaves may occur more than once during the curing process. However, excessive lavage of the leaves is not necessary. Preferably, green tobacco leaves are lavaged by spraying or washing thoroughly with a wash solution with or without agitation. For instance, the growing tobacco plants can be sprayed in the field close to harvest time or harvested plants or green tobacco leaves can be submerged with agitation in a wash solution. The tobacco leaves can be additionally rinsed or sprayed or submerged at least once, with or without agitation, during yellowing or after yellowing. Practitioners in the art will recognize that the lavage treatment can be adjusted to take into account numerous factors, such as the type of leaf and, therefore, the curing process being used (flue-cured or air-cured), the temperature and humidity conditions during curing, the length of time the leaves require to complete each step of curing, the appearance of the leaves themselves and the amount of bacteria or fungal growth present, etc.

After lavage with a disinfectant wash solution such as by spraying or immersion, the treated leaves may optionally be rinsed with plain water in order to remove the disinfectant solution. Because flue-curing requires rapid drying and high heat, particularly during lamina and stem drying, additional bacterial growth is minimal and the disinfectant solution is not necessary to control the bacterial population in these stages of curing. Some residual solution may be left on the leaves during flue-curing as well as air-curing, if desired. With the slow drying process of air-cured tobacco, the residuals can discourage bacterial growth and interfere with nitrosation reactions.

In the case where lavage is performed during curing, curing of the tobacco leaves can be resumed immediately or within 24 hours or less. The excess fluid on the leaves from lavage may be allowed to drip off the leaves and dry naturally, or forced air or heat may be used to hasten drying. Also, the leaves can be optionally rinsed with water. Forced air may be supplied by any means, such as by a fan or blower, or the curing barn may be opened for maximum ventilation. Other methods of forcing increased ventilation of the barn to hasten drying of the tobacco leaves, or of heating the leaves, will be apparent to practitioners in the art.

Flue-Cured Tobacco

Plants used for flue-cured tobacco (bright or Virginia tobacco) are grown, topped, ripened, harvested and then cured. Harvesting is undertaken by removing (priming) several leaves at intervals as the leaves ripen. The leaves are generally considered ripe when the midvein turns white. The leaves are removed beginning from the bottom of the stalk, and higher leaves are primed as they ripen. Primed leaves are bundled and placed in barns for curing. With traditional flue curing practices, the farmer initially maintains the barn at a high humidity, approximately 89% relative humidity, and at a temperature of about 30 to 35° C. (85 to 95° F.) for several days to effect yellowing of the leaf. After yellowing, the color of the leaves is fixed by heating the leaves to effect drying of the leaf lamina. Drying of the lamina is accomplished by raising the temperature in the barn to about 49 to 60° C. (120 to 140° F.) for 24 to 36 hours. Heating of the barn may be effected by any means, but generally propane heat is used. Once lamina drying has occurred, the farmer heats the barn to about 72 to 77° C. (160 to 170° F.) for 1 to 3 days to dry the mid-vein or stem of the leaves.

During the above drying processes, the leaves first take on a yellow color and chemical decomposition of the leaves begins, breaking down starch in the leaves to sugar, proteins to amino acids, and the like. As the tobacco leaves dry and turn brown, they become brittle and undergo necrosis, whereby the cuticle of the leaf cracks, exposing interior portions of the leaf tissues. After lamina and stem drying, the tobacco leaves are bulked or bundled together, and the moisture level within the leaves is raised ("reordered") to approximately 10 to 15% to facilitate handling of the tobacco leaves with less breakage. The tobacco leaves are then graded and sold to tobacco product manufacturers. See Colin L. Browne, *The Design of Cigarettes*, (1990) Hoechst Celanese Corporation, pp. 13–19. Flue-cured tobacco has a low nitrogen and high sugar content.

Flue-cured tobacco, such as bright tobaccos (or Virginia), that have undergone curing in barns directly heated with propane heat exhibit higher levels of TSNAs than does tobacco in similar barns equipped with heat exchangers. See D. M. Peele et al., "Formation of Tobacco Specific Nitrosamines in Flue-Cured Tobacco," 53$^{rd}$ *Tobacco Science*

*Research Conference* (1999) Vol. 53, pp. 68–69. Without wishing to be bound by theory, it is believed that allowing combustion gases containing oxides of nitrogen from the burning propane to impinge directly upon the curing leaves provides the primary source of TSNA formation in flue-cured-tobacco. Bacterial contributions to TSNA formation in flue-cured tobacco may be relatively minor. However, TSNA levels in flue-cured tobacco are also affected by the integrity of the green leaf before curing. Leaf damage and infection of tissue (so-called "barn rot") in the green leaf may cause increased TSNA levels from bacterial invasion of the damaged tobacco leaf.

The lavage treatment in accordance with the invention is beneficial in that TSNAs and endotoxins in the tobacco leaves can be reduced prior to the onset of conditions during flue curing favorable to bacterial growth and/or TSNA production.

FIG. 1 is a graphical representation showing the typical effects of flue curing on tobacco leaf moisture content in terms of oven volatiles (curve A), TSNA content (curve B) including effects of heating using direct fire propane (curve C) or using heat exchangers (curve D), and temperature (curve E). As shown by curves C and D, the effect of direct fire heating with propane raises the TSNA content considerably compared to heating with heat exchangers. In FIG. 1, various stages of curing are identified with: G (green), Y (yellowing), L (lamina drying) and MV (midvein drying). At the conclusion of flue curing, the leaves preferably have a moisture content of about 10% (oven volatiles). Afterwards, the leaves are preferably reconditioned to a moisture content of about 10 to 16%.

Figure 2:
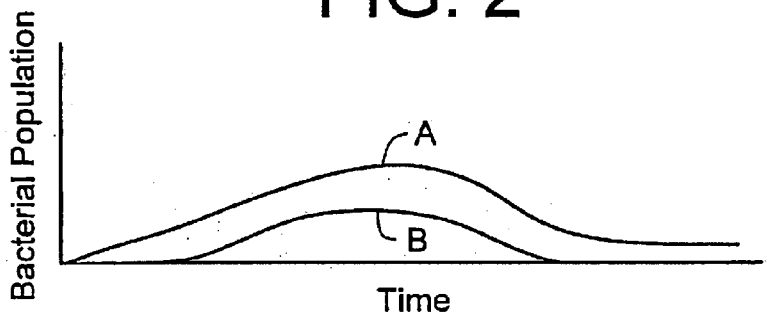
FIG. 2 is a general representation of bacterial population during flue-curing.

FIG. 2 shows the effects of the lavage treatment with a bactericidal agent in accordance with the invention on reducing the bacterial population on flue-cured bright tobacco. Curve A corresponds to flue cured tobacco which has not been subjected to a lavage treatment in accordance with the invention whereas curve B corresponds to flue cured tobacco which has been subjected to a lavage treatment. With antibacterial lavage, the inoculum (initial bacterial population) is lower. As a result, there is a greater lag period (the period after inoculation before which exponential growth of the bacteria population begins).

EXAMPLE I

Antibacterial Lavage

Bright tobacco from the 5th leaf position (tip) was harvested and loaded into standard Bulktobac curing racks (approximately 70 lbs. per rack). Individual racks were immersed in 70% ethanol for either 1 or 5 minutes then rinsed in water. After draining thoroughly the treated tobacco along with untreated control material was cured in a Bulktobac 32-rack curing barn equipped with a heat exchanger. A standard flue-curing profile was followed and the resultant tobaccos were lyophilized, ground and assayed for microbial counts. The results indicated that the ethanol treatment reduced the bacterial load in a dose dependent manner 1 to 2 orders of magnitude as compared to the control for the 1 and 5 minutes treatments, respectively. That is, the control exhibited a $10^8$ count whereas the 1 minute treatment exhibited a $10^7$ count and the 5 minute treatment exhibited a $10^6$ count. Similar results were achieved for treatment of the tobacco with 10.7 ppm $ClO_2$ in aqueous solution also using a 1 or 5 minute soak time and handling identically to the ethanol treated material.

Alkaline Lavage

In a typical air-curing process, tobacco plants are cured in an enclosure such as a barn for six to seven weeks. It has been found that bacteria and/or TSNAs begin to increase significantly after about 2½ weeks under such conditions.

The alkaline lavage treatment in accordance with the invention surprisingly and unexpectedly can reduce the curing time such that air-curing is completed before the onset of the conditions ripe for substantial bacteria growth and/or TSNA production. Due to more accumulation of TSNAs in the midveins of the leaves than in the lamina during air-curing, the midveins can optionally be removed from the cured leaves prior to further processing thereof.

Air-cured tobacco, which has traditionally comprised burley or Maryland tobaccos, is grown, topped, ripened and then harvested by cutting the entire plant at the base, known as stalk-cutting. Under prior, traditional practices, the plant is harvested when leaves approximately midway up the stalk have ripened. Usually, the stalk-cut tobacco is left to wilt for several days and then cured by being hung upside down along racks in a barn at a relative humidity of approximately 65 to 70% for 6 to 10 weeks. Heat and humidity levels are controlled by simply opening and closing ventilation ports in the barn. Generally, the yellowing process takes about 10 to 12 days, the leaves on the stalk turn from yellow to brown in another 6 to 7 days, and lamina and stem drying occur over an additional 30 to 40 days. The length of time for air-curing, and in particular for each individual step of air-curing, is highly dependent on the ambient temperature and relative humidity in the barn during air-curing. Air-cured tobacco generally has a very low sugar content and a high nitrogen content. In air curing external sources of nitrogen oxides are not present suggesting that bacterial action is the major cause of nitrosation in air-cured tobacco.

Figure 3:
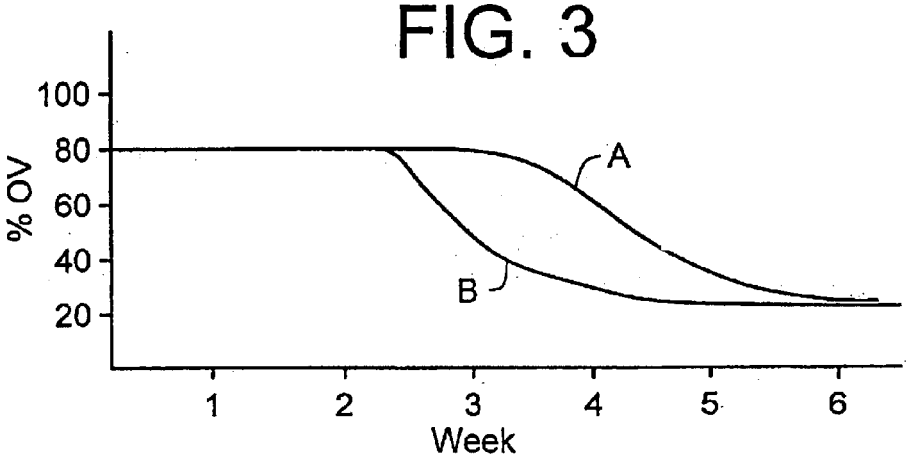
FIG. 3 is a general representation of moisture content during traditional air-curing.

FIG. 3 is a general representation of the effects of air-curing on tobacco leaf moisture, wherein curve A represents the moisture content of the tobacco leaf midvein and curve B represents the moisture content of the tobacco leaf lamina.

In accordance with a preferred embodiment of the present invention, i.e., the "alkaline lavage", the use of a solution of bicarbonate salt, preferably sodium bicarbonate, or carbonate salt, preferably sodium carbonate ($Na_2CO_3$), to treat air-cured tobacco such as burley has surprisingly and unexpectedly been found to decrease the air-curing time of the tobacco by at least about 25%, and preferably by about 50% or more. It has unexpectedly been discovered that green leaves of air-cured tobacco ravaged with a wash solution of bicarbonate salt before or immediately after commencing curing can turn brown within two weeks of the "alkaline lavage", as opposed to the normal four to six week period required from the start of curing. The treated leaves are moist and pliable when brown in contrast to the dry and brittle brown leaves of conventional air-curing. Using the lavage treatment in accordance with the invention, it has been found that leaves higher on the stalk have mostly brown lamina but somewhat yellow midveins after about two weeks of air curing.

In order to accommodate the different cure rates of the treated leaves, brown leaves can be selectively stripped from the hung stalk and dried by further air-curing at low humidity (below about 65%) and temperature or by circulating dry air or by heating, similar to what is used in flue-curing. The drying after priming preferably commences within 24 hours of stripping the leaf, and is preferably completed within 3 days or less. Such drying may in the alternative, be applied to the cured tobacco as it remains hanging in the barn.

Preferably, the drying step reduces the moisture content to at or below approximately 30 to 10% (oven volatiles), more preferably near 10% oven volatiles. The stripped leaf may be destemmed prior to drying, if desired, so as to remove from the usable tobacco lamina the midrib and any nitrosamines that may reside in the midrib.

The advantages of treating air-cured tobacco with a bicarbonate or carbonate salt solution are a shorter curing period of about 4 weeks or less, preferably 3 weeks or less, allowing additional harvests to be planted and air-cured in a season; lowered or eliminated bacterial levels or activity; lowered or eliminated TSNA levels; and lowered or eliminated bacterial endotoxin levels. The shortened curing time of the treated air-cured tobacco further aids in retarding bacterial growth, and therefore in reducing TSNA and bacterial endotoxin levels in the cured tobacco.

Although bicarbonate and carbonate solutions are preferred as curing-accelerating agents, it is believed that any suitable alkaline solution could be applied to the tobacco plant to shorten the time for the harvested tobacco to brown, or turn dark. The preferred wash solutions comprise aqueous solutions of carbonate and/or bicarbonate salts, particularly sodium carbonate and sodium bicarbonate, and/or other such salts such as potassium carbonate, potassium bicarbonate and ammonium carbonate. Other solutions (for example, dilute aqueous solutions of sodium hydroxide and/or potassium hydroxide) will be readily apparent to practitioners in the art after reading and understanding this disclosure.

Alternatively, air-cured tobacco leaves may be primed from the tobacco plant as they ripen (i.e., lower leaves are removed first), optionally destemmed, and cured with treatment as described herein to reduce or eliminate nitrosamine levels, bacteria, bacterial activity and/or bacterial endotoxins. Preferably, the leaves are treated with a carbonate and/or bicarbonate salt solution for accelerated curing as described herein.

EXAMPLE II

Alkaline Lavage

The "Carbonate Lavage"—Freshly stalk-cut harvested burley (Tn90) plants were hung on a stick, 5 plants per stick and hung on a scaffold, whereupon, leaves were sprayed until run-off with an aqueous solution of either 1% or 2% (weight/volume) of $NaHCO_3$ (sodium bicarbonate) and allowed to dry and wilt for three days and then hung in a conventional air-curing barn. Untreated controls were included. Once cured, the tobacco was dried (fixed) by passing dry air about the cured tobacco, preferably at approximately 85° F. By two weeks, older leaves (at the lower stalk positions) had become so brown as to be undistinguishable in pigmentation from untreated leaves that had cured for at least four to six weeks. The browned bicarbonate-treated leaves remained moist and pliable, in contrast to the dry and friable lamina that had been equivalently browned by conventional curing. Leaves at higher stalk positions of treated plants, i.e., developmentally younger leaves, had undergone complete browning at the tips and significant browning of their lamina after two weeks of curing, but their midveins were still somewhat yellow.

The following data was obtained upon chemical analyses of the tobacco described in this Example:

| | TN90 $NaHCO_3$ Treated At 5 Weeks of Curing | | | | | |
|---|---|---|---|---|---|---|
| Description (% $NaHCO_3$) | LL PM NNN (ng/g) | LL PM NAT (ng/g) | LL PM NAB (ng/g) | LL PM NNK (ng/g) | Bacteria per gram | Total TSNA's |
| Control 0% | 2071 | 3841 | 61 | 174 | 1.80E+06 | 6147 |
| 1% | 639 | 1250 | 30 | 51 | 1.31E+03 | 1970 |
| 2% | 329 | 1070 | 24 | 40 | 1.31E+05 | 1463 |

In addition to the reduction in the amount of time necessary for color development, the bicarbonate treated material displayed a reduction of total TSNA content (in ng/g) of 68% and bacterial load (in bacteria/g) of 3 orders of magnitude.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

What is claimed is:

1. In a process of air-curing tobacco leaves, the improvement comprising reducing air-curing time by treating the tobacco leaves with an alkaline curing accelerating agent.

2. The process according to claim 1, wherein the treating step comprises treating the leaves with a solution containing bicarbonate and/or carbonate anion.

3. The process according to claim 1, wherein said curing accelerating agent comprises an aqueous solution containing a bicarbonate and/or a carbonate salt, said bicarbonate salt comprising one or more of sodium bicarbonate, ammonium bicarbonate or potassium bicarbonate or the carbonate salt comprises one or more of sodium carbonate, ammonium carbonate or potassium carbonate.

4. The process of claim 2, wherein the air-curing includes the step of reducing moisture content of a darkened tobacco portion to a preselected, final moisture content in the range of 10 to 30%.

5. The process of claim 4, wherein the air-curing time is initiated and completed within 7 days.

6. The process according to claim 4, further comprising the steps of selectively stripping brown leaves from air-cured tobacco leaves during the air-curing, the method further comprising drying primed leaves apart from remaining leaves on the plant.

7. The process according to claim 4, wherein brown leaves are primed from air-cured tobacco leaves during the air-curing, the method further comprising drying the primed leaves after removing midveins of the primed leaves.

8. The process according to claim 5, wherein the air-curing is completed before substantial growth of bacteria on and/or production of TSNAs by the leaves.

9. A method of accelerating the coloring of tobacco during a curing process, said method comprising the steps of:

spraying a tobacco with aqueous solution of a carbonate or bicarbonate salt; and drying said sprayed tobacco into a cured condition, whereby time required to yellow said tobacco is reduced.

10. The method as claimed in claim 9, wherein said drying step includes placing said tobacco in an arrangement to effect air curing, said spraying step includes spraying said tobacco prior to said placing step.

11. The method as claimed in claim 10, further comprising the step of allowing the sprayed solution to at least partially dry on surfaces of said tobacco prior to said placing step.

12. The method as claimed in claim 11, wherein said drying step includes a fixing step of contacting said tobacco with dry air so as to establish a final cured condition of said tobacco, said fixing step being executed subsequent of said time required to yellow said tobacco, said fixing step being completed within seven days.

13. A process of converting green tobacco into smokable material, said process comprising the steps of:

initiating an air-curing treatment of green tobacco leaves, said air-curing treatment including the steps of transforming said green tobacco into a yellowed condition and the step of further transforming said tobacco into a darkened condition;

proximate in time to said initiating step, treating said tobacco with an alkaline curing-accelerating agent;

separating darkened tobacco leaves from yellowed tobacco leaves; and proximate in time to said separating step, drying said separated, darkened tobacco leaves;

repeating said further transforming, separating and drying steps upon remaining yellowed tobacco leaves.

14. The process of claim 13, wherein said drying step includes the step of reducing moisture content of the darkened tobacco portion to a preselected, final moisture content such that said dried tobacco does not support microbial activity.

15. The process of claim 14, wherein said drying step includes the step of reducing moisture content of the darkened tobacco portion to a preselected, final moisture content in the range of 10 to 30%.

16. The process of claim 15, wherein said drying step is completed within seven days.

17. The process of claim 14, wherein said method further comprises the step of destemming said separated, darkened tobacco portion.

18. The process of claim 14, wherein said curing-accelerating agent comprises a wash solution comprising a bicarbonate salt and/or carbonate salt.

19. The process of claim 14, wherein said tobacco is burley.

20. A method of treating tobacco leaves to effect curing comprising treating the leaves with an alkaline curing-accelerating agent, yellowing the leaves, browning the leaves and separately drying the browned leaves from remaining leaves.

21. The method of claim 20, wherein said curing-accelerating agent comprises a carbonate and/or bicarbonate salt.

* * * * *